United States Patent [19]

Watanabe

[11] 4,333,296

[45] Jun. 8, 1982

[54] COIN WRAPPING MACHINE

[75] Inventor: Kenkichi Watanabe, Tokyo, Japan

[73] Assignee: Tokyo, Japan

[21] Appl. No.: 129,839

[22] Filed: Mar. 13, 1980

[30] Foreign Application Priority Data

Mar. 15, 1979 [JP] Japan ..... 54-30230

[51] Int. Cl.[3] ..... B65B 57/04; B65B 11/04

[52] U.S. Cl. ..... 53/64; 53/212

[58] Field of Search ..... 53/212, 505, 508, 64; 133/1 A, 8 A

[56] References Cited

U.S. PATENT DOCUMENTS

| | | | |
|---|---|---|---|
| 3,821,917 | 7/1974 | Hatanaka | 53/212 |
| 3,938,303 | 2/1976 | Ushio | 53/212 |
| 4,138,834 | 2/1979 | Nobumro | 133/1 A X |
| 4,159,607 | 7/1979 | Uchida et al. | 53/212 |
| 4,234,002 | 1/1980 | Uchida et al. | 53/212 |

*Primary Examiner*—John Sipos

*Attorney, Agent, or Firm*—Fleit & Jacobson

[57] ABSTRACT

A coin wrapping machine in which kinds of coins are wrapped with wrapping papers at a wrapping section is provided. Coin kind cams for setting initial positions of various operational portions of the machine are shaped to accommodate to all kinds of coins issued in a country. A support for detachably mounting paper units to supply wrapping paper to the wrapping section of the machine is adapted to preload a specific number of paper units for supporting wrapping paper suitable for the specific number of kinds of coins highly circulated in the country less than the number of all kinds of coins issued in the country. A motor for driving the support is separately provided from another motor for driving some of the coin kind cams. Therefore, when the kind of coins to be wrapped does not correspond to one kind of coins highly circulated in the country, another paper unit is substituted for one of the preloaded paper units.

6 Claims, 5 Drawing Figures

COIN WRAPPING MACHINE

BACKGROUND OF THE INVENTION

The present invention relates to a coin wrapping machine being most suitable to a case where kinds of circulating coins extend over various kinds or a case where new coins have been put in circulation. In some countries, four kinds of coins are being circulated and, in other countries, eight or twelve kinds of coins are being circulated and, in general, five or six kinds of coins are being circulated in almost all the countries in the world.

In fact, there is a growing tendency owing to economical circumstances such as inflation or the like in world countries that kinds of coins are increasing, however, among kinds of coins being circulated in world countries, the coins having a high degree of circulation are only two or three kinds.

Under these circumstances, in coin wrapping machines, wrapping paper (for example, wrapping paper on which the kinds, number and value of coins are printed) suitable for each kind of coins is charged separately into wrapping paper units to be placed in the support of the coin wrapping machines. The wrapping paper is automatically assorted and selected according to a paper selection of a coin to be wrapped and the wrapping paper thus selected is moved from a supply portion toward a wrapping portion.

Such being the case, coin wrapping machines up to now have been equipped with wrapping paper for use with every kind of coins circulated and therefore, coin wrapping machines themselves have been large-sized with a heavy load thereon and, as a consequence, motors and other accessories for such large-sized wrapping machines must have mechanical strength that bears such heavy load, thereby prices of the wrapping machines have become higher and at the same time, it has been difficult to transfer or remove such heavy machines.

It is possible to wrap up the accumulated coins of the one kind in the same wrapping paper as those used for wrapping up the accumulated coins of the other kind so long as the height of the accumulated coins of two different kinds are the same as or similar to each other, while it is possible to wrap up the accumulated coins of the one kind in wrapping paper (on which a kind of coins to be wrapped is already printed) to be used for the accumulated coins of the other kinds and therefore, it would eventually be necessary to change the wrapping paper of every kind fitted to the kinds of coins being circulated. In addition, conventional coin wrapping machines are so constructed that a mechanism which sets up the initial position of a starting for crimping of crimping claws is mechanically driven in cooperation with a mechanism of wrapping paper supplying units.

SUMMARY OF THE INVENTION

According to the present invention, it is possible to wrap up accumulated coins with wrapping paper supply devices even if the height of the accumulated coins is different from one another. A motor by which the wrapping paper supply device is driven and a motor which is set up to select the crimping position are provided separately in the present invention and, a cam surface being suitable for all kind of coins presently circulated in a country is provided on the coin kind setting cam and, wrapping paper units fitted to coin kinds presently circulated to a greater extent in a country are provided in the wrapping paper supply device.

In cases where it becomes necessary to wrap up a kind of coins (wrapping paper to be used therefor is not supplied in the wrapping paper supply device) through a selection of a coin kind setting dial, working of the wrapping paper supply device becomes impossible, which prevents the wrapping paper supply device from miswrapping.

In such a case, the wrapping paper supply device can be used again by setting up the wrapping paper units of wrapping paper to be used for a kind of coins previously selected by the coin kind setting dial.

According to the present invention, there is provided a coin wrapping machine in which kinds of coins are wrapped with wrapping papers at a wrapping section which comprises a coin kind setting dial, coin kind cams set by said coin kind setting dial to accommodate initial positions of operational portions of the machine to the kind of coins to be wrapped selected in accordance with said coin kind setting dial, said coin kind cams being shaped to be suitable for all coins issued in a country, first driving means for driving a portion of coin kind cams to set the same in positions in accordance with the setting of said coin kind setting dial, a support for detachably mounting paper units to supply wrapping papers to the wrapping section of the machine, said support pre-loading a specific number of paper units for supporting wrapping papers suitable for the specific number of kinds of coins highly circulated in the country less than the number of all kinds of coins issued in the country, and second driving means for rotating the support to set the same in a position, whereby when the kind of coins to be wrapped does not correspond to one kind of coins highly circulated in the country, another paper unit is substituted for one of the pre-loaded paper units.

DETAILED DESCRIPTION OF THE PREFERRED EMBODIMENT OF THE INVENTION

Figure 1:
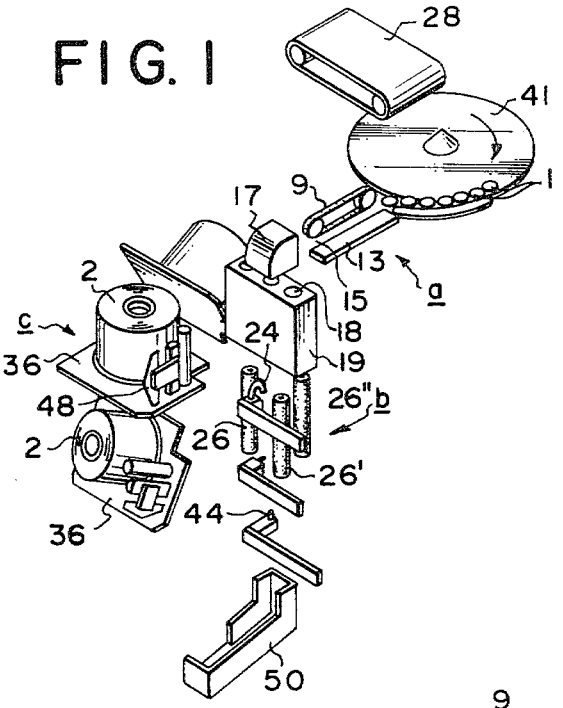
Figure 2:
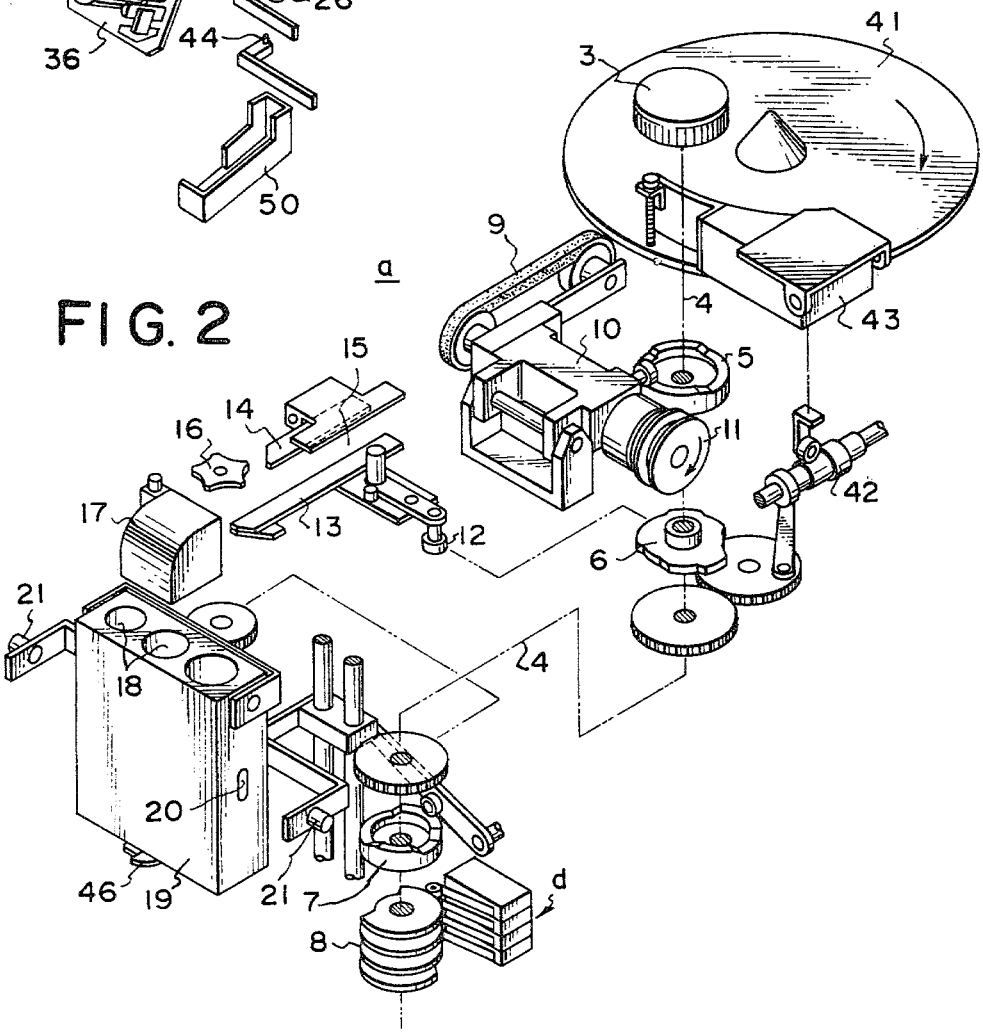
Figure 3:
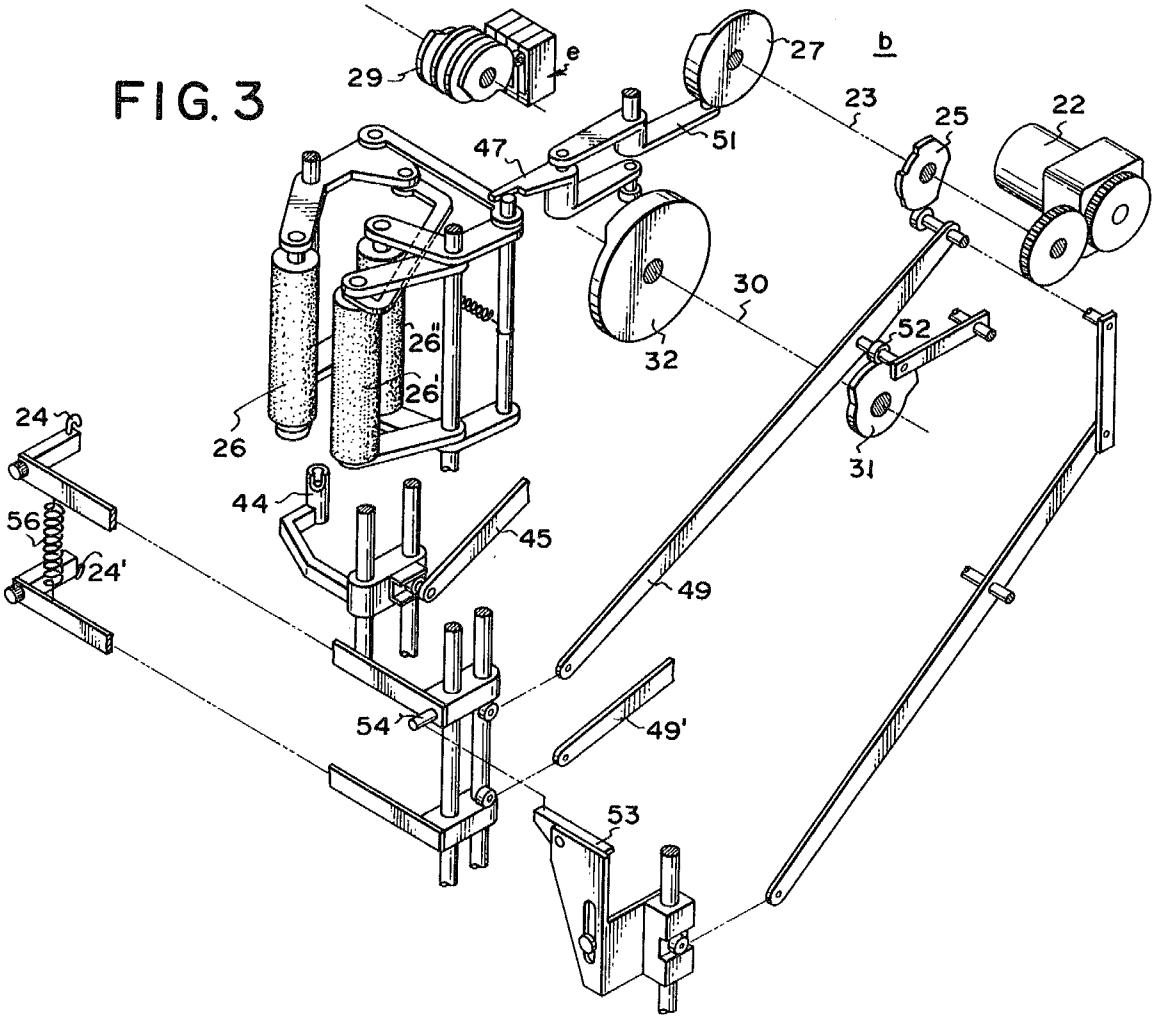
Figure 4:
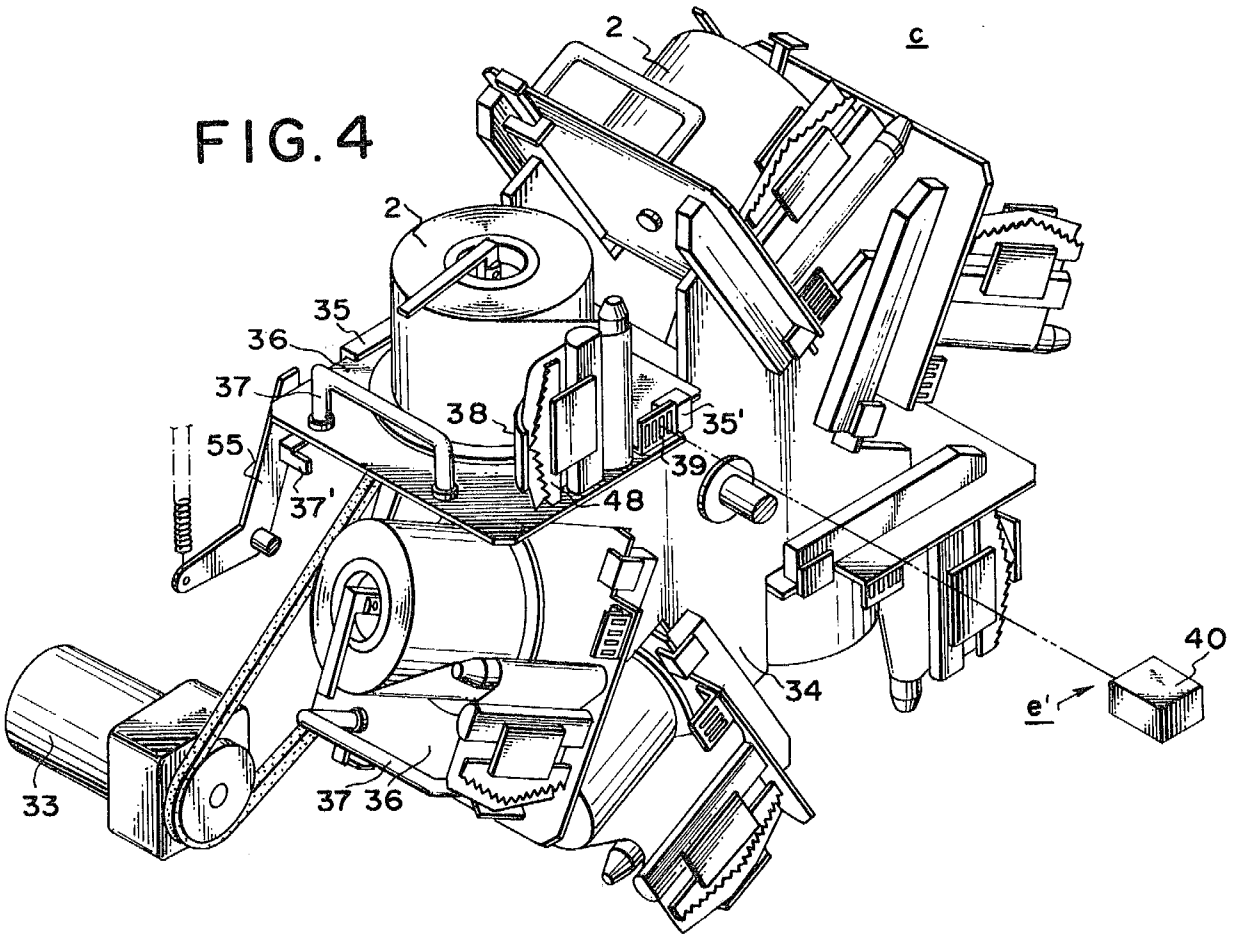
Figure 5:
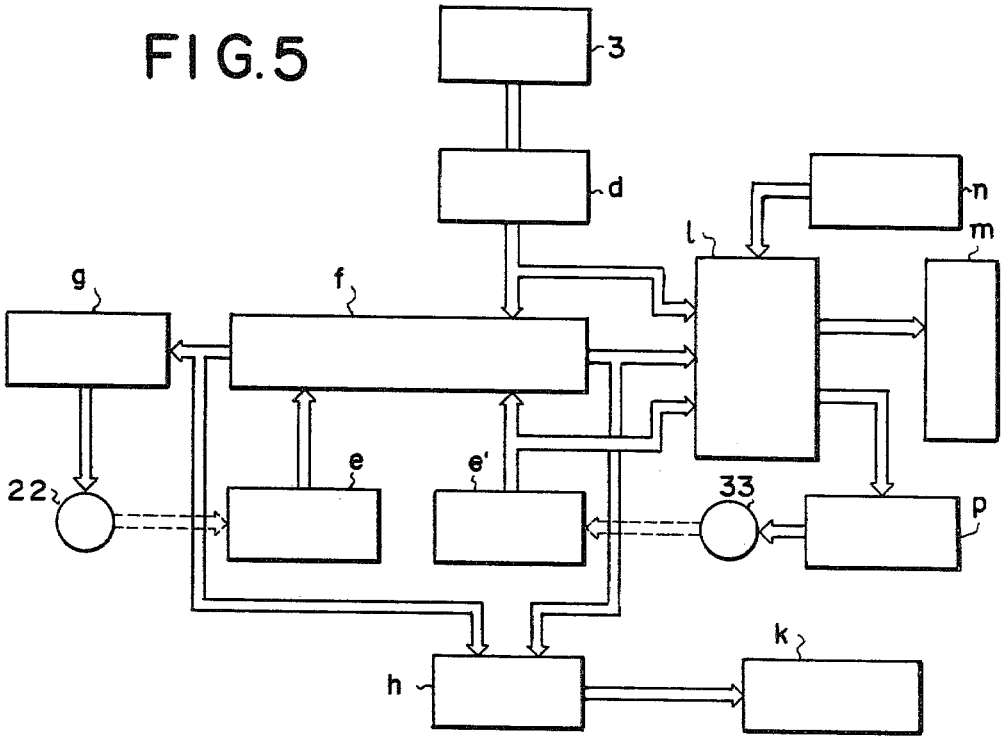

The invention will now be described in detail with the reference to the accompanying drawings in which:

FIG. 1 is a perspective view showing the main portion of the coin wrapping machine according to the present invention, FIG. 2 is a perspective view showing the main portion of the assorting and counting section of the coin wrapping machine, FIG. 3 is a perspective view showing the main portion of the wrapping section of the coin wrapping machine, FIG. 4 is a perspective view showing the main portion of the wrapping paper supplying section of the coin wrapping machine, and FIG. 5 is a block diagram showing the operation of the coin wrapping machine.

Referring now to FIG. 1, a shows an assorting and counting section for coins 1, b shows a wrapping section for wrapping a predetermined number of coins with wrapping paper 2 and crimping the coins, and c shows a wrapping paper supplying device which includes supports for wrapping papers. In general, the device c is constructed so that it has six supports for supporting six kinds of the wrapping papers. The wrapping paper thus supported are pre-selected to be suitable for six kinds of coins of higher circulation. Although the present invention will be explained with reference to the wrapping paper supplying device which has six supports for wrapping papers, the present invention will not be limited to that and may be applied to any suitable number of supports. However, the device with six supports is preferably used in the present invention since the conventional machine which has the device with six supports can be utilized by a mere alteration thereof.

Referring to the assorting and counting section in FIG. 2, when a coin kind setting dial 3 is rotated in accordance with the kind of coins to be wrapped, a thickness control cam 5, an assorting path correcting cam 6, a detecting cam 7 for detecting misalignment of the accumulated coins, and a group of cams 8 in a detection section d are rotated by rotation of the shaft 4 of the coin kind setting dial 3 to be adjusted to the thickness, the width, the accumulated thickness, etc of the coins to be wrapped.

More particularly, a bearing 10 which supports a feed belt 9 is moved by means of the thickness control cam 5 to adjust the height of the feed belt 9 to the thickness of the coins to be wrapped. The feed belt 9 is rotated by a pulley 11 which in turn is driven by a motor 22 (in FIG. 3).

The assorting path correcting cam 6 serves to adapt the width of an assorting path 15 for the diameter of the coins to be wrapped by moving a movable guide 13 with respect to a fixed guide 14 through a cam follower 12. At the bottom of the assorting path 15 is formed a selecting opening, not shown, which allows the coins of smaller diameter to fall down through the opening and to be removed.

The reference numeral 16 indicates a star wheel for counting coins wherein each tooth of the star wheel is angularly driven by each coin and the angular movement of the star wheel is counted in a counter, not shown. This star wheel 16 is adapted to be stopped when a preset number of coins has been counted in a counter.

At the end of the coin path 15, a chute 17 is provided. Below the chute 17, a coin accumulating box 19 is slidably or rotatably provided so that one of accumulating cylindrical apertures 18 provided in the box 19 is disposed just below in accordance with the setting of the coin kind setting dial 3. The apertures 18 correspond to the diameters of the coins. Instead of the box 19, each coin accumulating cylinder corresponding to each kind of the coins may be individually replaced. The accumulating box 19 is provided with through-holes 20. On the line passing through the through-holes 20, a misalignment detecting device 21 comprising a light emitting element and a light receiving element is provided for detecting the misalignment of the coins accumulated in the box 19 such as the coins accumulated inclinedly. The height of the misalignment detecting device 21 can be changed by the detecting cam 7 to accommodate with the height of the accumulated coins.

In the present invention, the aforementioned cams 5, 6, and 7 are made to accommodate all kinds of the coins issued in a country. For example, assuming that a country issues eight kinds of coins, the cams 5, 6 and 7 are made to set each of eight kinds of the coins. These cams can be provided in the machine according to the present invention by merely replacing the cams suitable for six kinds of the coins used in a conventional machine with these cams used in the present invention.

At the wrapping section b, a cam shaft 23 is rotated by a motor 22 as shown in FIG. 3. To the cam shaft 23 is attached a claw position cam 25 for causing at least one of crimping claws 24, 24' to move to the initial position of the claws corresponding to the height of the accumulated coins. A roller position cam 27 for adjusting the initial position of wrapping rollers 26, 26', 26'' in accordance with the diameter of the coins to be wrapped and a group of cams 29 in a detecting section e are also attached to the cam shaft 23. A claw cam 31 interlocked with the claws 24 and 24' and a roller cam 32 interlocked with the rollers 26, 26' and 26'' are provided on a driven shaft 30.

At the wrapping paper supplying section c, as shown in FIG. 4, wrapping paper units 36 are guided along the rails 35 and 35' by grasping a grip 37 by hand and moving the same and are detachbly mounted on a support 34 which is rotated by a drive motor 33. The units 36 are locked to the support 34 by a locking device 37' when the units 36 are loaded.

The support 34 usually or initially accommodates six units 36 which correspond to six kinds of the coins most highly circulated among kinds of the coins issued to a country.

Therefore, in the present invention, the support 34 and associated mechanism is made to be the same as those of the conventional machine or is not changed from the conventional machine.

Each wrapping paper 2 is attached to each unit 36 and has its leading end held by a guide 38. An identification element 39 with a code corresponding to the kind of the coins to be wrapped with the wrapping paper is provided.

At a wrapping paper detecting section e', a responsive element 40 for reading the code of the element 39 is disposed on the frame of the machine. When the element 39 is located at a position where its wrapping paper is supplied to the wrapping section b, the code of the element 39 can be read by the element 40. The elements 39 and 40 may be constructed optically or electrically. For example, a microswitch and an actuator may be provided on the unit 36 and the frame of the machine, respectively.

As the coins 1 drop onto a rotary disc 41 from a supply belt 28, the coins 1 are given a centrifugal force by rotary disc 41 and moved along the circumferential portion of the disc 41. The coins thus moved are transported one by one downwardly of the feed belt 9 without overlapping below a gap adjusting block 43. The block is adjusted by a slider cam 42 which is moved auxially by rotation of the shaft 4.

Further, in the present invention, the aforementioned cams 25, 27 and 42 are also made to accommodate all kinds of the coins issued in a country. In this way, the coins 1 travel in the path 15. The coins 1 are counted by the star wheel 16 one by one and fall through the chute 17 into one of accumulating apertures selected by the coin kind setting dial 3. As a given number of coins are accumulated in one of the apertures 18, a coin supporting rod 44 is lifted by a lever 45 and is brought up to a position just below a shutter 46 provided below the aperture in contact relationship with the box 19. At this instant, the shutter 46 is opened and the accumulated coins are supported on the coin supporting rod 44. Then, the coins thus supported are downwardly transported to a central position among the wrapping rollers 26, 26' and 26'' by downward movement of the coin supporting rod 44. Then, a lever 47 is actuated by the roller cam 32, so that the accumulated coins are held by the wrapping rollers. A preset wrapping paper 2 is pulled by rotation of the rollers while the coins are wrapped with the wrapping paper and cut in a predetermined length by a cutter 48.

Then, the claws 24 and 24' move into the wrapping rollers and crimp both ends of the wound wrapping paper through the crimping levers 49 and 49'. In this way, the wrapping is completed and the wrapped coins are led into a discharge chute 50, followed by the outward movement of the rollers. The rollers are controlled to be located on a circle line which is slightly larger than the diameter of the coins by a control lever 51.

The crimping claws 24 and 24' are initially set to the accumulation height of the coins by the crimping lever 49 rotatable about the axis of a roller 52 by the claw position cam 25. At the time of the crimping, the crimping lever 49 is actuated by the crimping cam 31 to be rotated about the point where the crimping lever 49 contacts the claw position cam 25. Consequently, the crimping claws 24 and 24' are moved toward each other by a spring 56, and thereby crimping both ends of the wrapping paper with which the coins are wrapped. Reference numeral 53 indicates a detecting device for detecting lack of amount of the wrapped coins wherein the height of the wrapped coins is detected upon completion of the crimping by contact of one end of the detecting device 53 with a pin 54 moving up and down together with the crimping claw 24. If the amount of the wrapped coins is lacking, the wrapped coins are adapted to be discharged.

Now, explanation about the setting of coin kind cams (cams 5, 6, 7, 25, 27 and 42) and of the wrapping paper supplying device will be made.

When the coin kind setting dial 3 is set to the kind of coins to be wrapped, all coin kind cams are set in a similar manner to the conventional machine. More particularly, when the dial 3 is rotated to be set, the cams 5, 6, 7 and 42 (in FIG. 2) are rotated in accordance with rotation of the dial 3 to be set to the thickness, the width etc of the coins. At the same time, the rotation of the dial 3 generates a coded coin kind signal by the group of cams and associated group of switches at the detection section d. The coded signal thus generated is put in the comparator f. At the comparator f, the coded signal is compared with the coded signal generated by group of cams 29 and associated switches at the detecting section e. Due to the change of the coin kind, a lack of coincidence signal is issued and put in a setting motor driving section g. A rotation signal is then issued by the motor driving section g and transmitted to the motor 22. The motor 22 is rotated by the rotation signal to set the cams 25 and 27 in positions which correspond to the kind of coins to be wrapped. When the cams 25 and 27 are set, the coded signal generated by the group of cams 29 and the associated switches at the detecting section e become coincident with the coded signal generated by the dial 3. Therefore, the comparator f generates a coincidence signal, which is transmitted to the motor driving section g and thereby stopping the rotation of the motor 22.

Upon completion of the setting of the coin kind cams, the coincidence signal thus generated is transmitted to a setting completion detecting section h.

The aforementioned operation is made for all kinds of the coins.

Simultaneously with the setting of the coin kind cams, the setting of the wrapping paper supplying device is also made. As mentioned above, the setting of the coin kind setting dial 3 generates a coded signal at the detection section d, but the coded signal is adapted to discriminate one kind of coded signal A indicating six kinds of the coins to which wrapping paper pre-loaded on the wrapping paper supply device correspond and the other kind of coded signal B indicating the other kind of the coins different from the above-mentioned six kinds of the coins.

When the dial 3 is set to one kind of the coins among the six kinds of coins corresponding to the preloaded papers, the coded signal A is transmitted from the detection section d to the comparator f. An another coded signal C corresponding to the kind of the coins to which the wrapping paper set in a supplying position corresponds has been put in the comparator f from the detecting section e'. At the comparator f, the coded signal A is compared with the another coded signal C, and due to the setting of new kind of the coins, a lack of coincidence signal is transmitted to a support driving control section l. The lack of coincidence signal energizes the motor 33 through the setting motor driving section p and the motor 33 rotates the support 34 to be brought to a setting position to which the kind of the coins accommodates. At this time, a coincidence signal is issued to stop the motor 33 through the setting motor driving section p. Simultaneously with this, the coincidence signal is transmitted to the setting completion detecting section h.

When the section h receives both of the coincidence signal by the setting of the coin kind cams and the coincidence signal by the setting of the support, the section h issues a signal to a start control section k and thereby starting the wrapping operation of the machine.

When the dial 3 is set to a kind of the coins different from the six kinds of the coins, the coded signal B is transmitted from the detection section d to the comparator f and simultaneously transferred to the support driving control section l. In this case, the comparator f issues a lack of coincidence signal which in turn is transferred to the control section l. The coded signal B and the lack of coincidence signal at the control section l cause a signal to be transmitted to the indicator m for indicating the necessity of the replacement of the wrapping paper by a lamp, a buzzer etc. Consequently, malfunction of the wrapping operation is prevented. At this time, no signal is issued to the setting motor driving section p and, therefore the motor 33 is not driven. Then, the locking device 39' is released to remove the mounted unit 36 out of the support 34 by pulling the same by hand through the grip 37. Thereafter, a new paper unit 36 which is suitable for the kind of coins to be wrapped is mounted. The coded identification element 39 of the mounted paper unit is then read by the responsive element 40 at the wrapping paper kind detecting section e' to be transmitted to the comparator f and then the coincidence signal is issued to the setting completion detecting section h.

In case that one kind of coins among the six kinds of coins corresponding to the pre-loaded papers is set from the other kind of coins different from the abovementioned six kinds of the coins by the setting of the dial 3, a lack of coincidence signal is issued from the comparator f. Since the signal B is still issued from the detecting section e', the support driving control section l issues a signal indicating removal of the paper unit. When a reset button n is depressed after the replacement of the paper units, a signal is transmitted from the support driving control section l to the setting motor driving section p to set the paper unit in a position. After the setting of the paper unit, a coincidence signal is issued to the setting completion detecting section h.

By the completions of the setting of the coin kind cams and the setting of the support, the setting completion detecting section h issues a signal to the function start control section k to start the operation of wrapping.

What is claimed is:

1. A coin wrapping machine in which kinds of coins are wrapped with wrapping paper at a wrapping section which comprises:

a coin kind setting dial (3), coin kind cams (5, 6, 7, 25, 27 and 42) set by said coin kind setting dial (3) to accommodate initial positions of operational portions of the machine to the kind of coins to be wrapped selected in accordance with setting of said coin kind setting dial (3), said coin kind cams (5, 6, 7, 25, 27 and 42) being shaped to be suitable for n-number of different sized coins, first driving means (22) for driving a portion of said coin kind cams (25 and 27) to set the same in positions in accordance with the setting of said coin kind setting dial (3), a support (34) for detachably mounting paper units (36) to supply wrapping papers to the wrapping section (b) of the machine, said support (34) preloading a specific number of paper units (36) for supporting wrapping papers, said specific number being less than the n-number of coins, second driving means (33) for rotating the support (34) to set the same in a position determined by the setting of said coin kind setting dial, and a detection section (d) for generating a coded signal representative of the kind of coins selected by the coin kind setting dial (3), a support driving control section (l) connected to the detection section (d) for comparing the coded signal from the detection section (d) with a plurality of another coded signals prestored in the support driving control section and for generating one of a first signal and a second signal, said another coded signals being representative of said specific numbers of paper units which are the only ones pre-loaded on all the paper units (36), said first signal energizing said second driving means (33) and said second signal preventing the activation of said second driving means (33) to allow replacement of one of said wrapping papers, wherein said first signal is generated when the coded signal is coincident with one of said another plurality of coded signals, and said second signal is generated when the coded signal is not coincident with one of said another plurality of coded signals.

2. A coin wrapping machine as set forth in claim 1, wherein, after said second signal has been generated and one of said paper units (36) has been removed from said support (34) and replaced with a different paper unit, a third signal indicating replacement of one of the paper units is generated.

3. A coin wrapping machine as set forth in claim 2, wherein said second signal is eliminated when the different paper unit is positioned on the support so that it supplies one kind of wrapping paper suitable for the selected kind of coins to be wrapped.

4. In a coin wrapping machine for wrapping different kinds of coin with wrapping paper identifying the kind of wrapped coin, the machine having a coin kind setting dial movable between a first plurality of positions representative of the kinds of coins to be wrapped; adjustable means for sorting and counting coins to be wrapped and for which kinds of coins wrapping paper is available in one of a plurality of wrapping paper supply units; an adjustable wrapping section for wrapping a predetermined number of coins with wrapping paper; paper supply means for supplying wrapping paper to said wrapping section, said paper supply means comprises said plurality of wrapping paper supply units for supplying wrapping paper with each unit carrying a paper supply, support means with a plurality of support locations for supporting the wrapping paper supply units, and means for moving said support means so that a selected wrapping paper supply unit is positioned such that wrapping paper is feedable therefrom to said wrapping section; and control means responsive to setting of said coin kind setting dial for adjusting said means for sorting and counting, for adjusting said wrapping section, and for actuating said means for moving of said paper supply means, the improvement wherein:

said coin kind setting dial is movable between a second plurality of positions, each of the second plurality of positions being representative of a type of wrapping paper not available in one of the wrapping paper supply units supported by said support means, said means for sorting and counting coins and said wrapping section are movable into positions corresponding to the second plurality of positions, and said control means is responsive to each of the second plurality of positions of said coin kind setting dial to adjust said means for sorting and counting and to adjust said wrapping section, said control means actuating said means for moving when the set position is representative of a type of wrapping paper available in one of the wrapping paper supply units supported by said support means and initially preventing actuation of said means for moving when said coin kind setting dial is set in one of said second plurality of positions to allow replacement of one of said wrapping papers.

5. The improvement of claim 4, wherein said control means further comprises:

means for generating a wrapping paper supply unit replacement signal when said coin kind setting dial is set in one of said second plurality of positions.

6. The improvement of claim 4 or 5, wherein each of said wrapping paper supply units comprises indicating means for indicating the type of wrapping paper in the supply unit, and wherein said control means further comprises means responsive to said indicating means for actuating said means for moving after a wrapping paper supply unit has been removed from said support means and replaced with a wrapping paper supply unit containing wrapping paper corresponding to the set position of said coin kind setting dial.

* * * * *

UNITED STATES PATENT AND TRADEMARK OFFICE

CERTIFICATE OF CORRECTION

PATENT NO. : 4,333,296

DATED : June 8, 1982

INVENTOR(S) : Kenkichi WATANABE

It is certified that error appears in the above—identified patent and that said Letters Patent is hereby corrected as shown below:

On the title page, before line [21] insert:

Assignee: Laurel Bank Machine Co., Ltd., Tokyo, Japan

Signed and Sealed this

*Fourteenth* Day of *December 1982*

[SEAL]

*Attest:*

GERALD J. MOSSINGHOFF

*Attesting Officer*

*Commissioner of Patents and Trademarks*